United States Patent [19]

Tuchida et al.

[11] 3,992,865

[45] Nov. 23, 1976

[54] METHOD AND APPARATUS TO START INTERRUPT AND STOP SPINNING OF A FASCIATED SPUN YARN

[75] Inventors: Nobuo Tuchida; Seiichi Yamagata; Masaaki Sakai; Itsuo Nakamura; Tadashi Kohara, all of Otsu; Syozo Morishita, Kyoto; Satoshi Kukino, Otsu, all of Japan

[73] Assignee: Toray Industries, Inc., Tokyo, Japan

[22] Filed: July 29, 1975

[21] Appl. No.: 599,962

[30] Foreign Application Priority Data

| | | |
|---|---|---|
| Oct. 9, 1974 | Japan | 49-115461 |
| Nov. 22, 1974 | Japan | 49-133564 |
| Feb. 19, 1975 | Japan | 50-19916 |

[52] U.S. Cl. ..... 57/51; 57/34 R; 57/81; 57/156

[51] Int. Cl.[2] ..... D01H 5/26; D02E 1/16

[58] Field of Search ..... 57/34 R, 34 B, 51, 81, 57/83, 36, 157 R

[56] References Cited

UNITED STATES PATENTS

| | | | |
|---|---|---|---|
| 3,079,746 | 3/1963 | Field | 57/51 |
| 3,354,631 | 11/1967 | Elias et al. | 57/83 X |
| 3,367,095 | 2/1968 | Field | 57/34 B X |
| 3,490,219 | 1/1970 | Ozawa et al. | 57/157 F X |
| 3,727,391 | 4/1973 | Hiserman et al. | 57/36 |

*Primary Examiner*—Donald E. Watkins

[57] ABSTRACT

Method and apparatus for starting, interrupting or stopping spinning of a fasciated spun yarn. Staple fibers are false twisted into a yarn, a fluid eddy is applied to the bundle, and separate suction is applied, cutting off temporarily the suction air current separately provided. Yarn formation is continued while reapplying the suction air current separately applied.

27 Claims, 16 Drawing Figures

METHOD AND APPARATUS TO START INTERRUPT AND STOP SPINNING OF A FASCIATED SPUN YARN

DETAILED DESCRIPTION OF THE INVENTION

The present invention relates to a method and an apparatus for starting, interrupting or stopping spinning of a fasciated spun yarn. As referred to herein, the term "fasciated spun yarn" means yarn in which surface staple fibers helically coil around substantially parallel and non-twisted core staple fibers, either irregularly or preferably regularly.

An object of the present invention is, by a novel method and a novel apparatus, firstly, to start the spinning of a fasciated spun yarn simply and with certainty, without using any auxiliary yarn; secondly, without causing problems, treating yarn breakage when it occurs during the spinning of the fasciated spun yarn, and thirdly, temporarily stopping the drive of the entire fasciated yarn spinning machine even in the absence of yarn breakage and thereafter restarting the machine without causing yarn breakage.

Another object of the present invention is to provide an excellent apparatus for producing a fasciated spun yarn which is capable of producing a yarn at a much higher speed and at a lower cost than known open end spinning machines, and having good operating characteristics for producing a yarn which is usable for general purposes.

In a method for producing fasciated spun yarn, a bundle of staple fibers is forwarded from a pair of wide top and bottom front nip rollers, and false twist is imparted thereto by a fluid eddy (vortex) nozzle. The core (central) portion of the bundle of staple fibers is strongly twisted. However, the fibers on both edges of the bundle are only weakly twisted. When the bundle passes through a fluid eddy nozzle in this condition and is detwisted, a yarn is formed in which a core bundle of staple fibers becomes substantially detwisted, while the surface fibers coil irregularly and helically around the core. In one of its aspects, the present invention is applicable to production of such fasciated spun yarn. However, more preferably, the present invention is applied to a method for spinning a fasciated spun yarn which comprises forwarding a bundle of staple fibers from a pair of top and bottom transfer aprons, the downstream ends of which are separated from each other on downstream supporting rollers, arranging the outside fibers on both edges of the bundle of staple fibers with both ends free, adhering these fibers to the surface of the bundle, false twisting by use of a fluid false twisting nozzle, in a parallel, weakly restricted and non-twisted condition by utilizing a suction tube which provides a suction air current, detwisting the core fibers, thereby transferring the surface fibers to a staple position by the expansive power brought about when the core fibers become detwisted, and thereby coiling the surface fibers around the core fibers regularly and helically.

As a typical showing a conventional method and apparatus for producing a fasciated spun yarn, U.S. Pat. No. 3,079,746 may be cited. This patent forms a fasciated spun yarn by use of an aspirating jet disposed just behind a pair of front nip rollers and a torque jet spaced at the rear of said aspirating jet. Therefore, in this patent, it is necessary to start up spinning by using an auxiliary yarn in advance, or by using a troublesome, uncertain operation of subjecting a weak, incomplete yarn in which the surface fibers coil only weakly, coming out from the aspirating jet further to the torque jet. Also, in said patent, nothing is suggested which relates to effective method of treating yarn breakage, temporary stopping of the spinning machine as a whole and restarting the spinning machine.

The present invention makes it easy to achieve the aforementioned objects by disposing a fluid eddy nozzle attached to a suction tube, which makes it possible to bundle and adhere surface fibers on and to the surface of a bundle of core staple fibers and to suck and remove temporarily staple fibers at the time of yarn breakage and restarting spinning, just behind a staple fiber feed means having a nip point.

For simply and reliably starting up the spinning of a fasciated spun yarn without using an auxiliary yarn, which is a first object of the present invention, the following operations are carried out.

Just behind and adjacent to a feed means for staple fibers, consisting of a pair of front nip rollers preferably constituting the front portion of a draft apparatus, or more preferably consisting of a pair of transfer aprons so mounted as to be separated from each other at the downstream ends thereof on said front rollers, a suction tube is provided for a bundle of staple fibers which are arranged to pass therethrough, connected to a suction apparatus. A fluid eddy nozzle is directly connected to or integral with this suction tube. Said fluid eddy nozzle is adapted as to provide a revolving action and, at the same time, a sucking action in normal operation. Also, it concurrently provides a temporary sucking action at least at the time of starting up the spinning operation. Further, the suction air current provided in the suction tube through a branch pipe by the action of the suction apparatus is capable of being temporarily interrupted.

Upon starting up the spinning operation, staple fibers forwarded as a bundle from a feed means are sucked and removed to the suction apparatus via a branch pipe of the suction tube. Thereafter, suction air current temporarily provided in the branch pipe is suddenly stopped. At the same time, a bundle of staple fibers further supplied is sucked into the fluid eddy nozzle by the sucking action of the fluid eddy nozzle which is provided at least temporarily at this time, and the bundle is false twisted. The central portion and the edge portions of a bundle of staple fibers broadly supplied as a ribbon are given unequal twists which differ in strength. They are then detwisted, and a fasciated spun yarn is formed in which the surface fibers helically coil around the core (central) fibers, which come out from the fluid eddy nozzle together with the air current. Thereafter, the suction action of the suction apparatus is applied to the suction tube again, by which the yarn is transferred to a normal spun condition. At the same time, the yarn may be wound up, using a winder and a take-up device.

Starting up spinning may be similarly carried out, besides the foregoing, by stopping the suction air current in the branch pipe of the suction tube in advance. The supply of the bundle of staple fibers is started up so that it is subjected to the sucking action of the fluid eddy nozzle.

In order to carry out the aforementioned method of spinning reliably and without fail, it is necessary that the distance from the nip point of the fiber forwarding device to the twist point of the fluid eddy nozzle, namely, the compressed fluid jet point, be less than the length of the maximum fiber contained in the bundle of staple fibers supplied.

In order to provide the fibers at both edges of the supplied bundle of staple fibers with both ends completely free, and to obtain a fasciated spun yarn having a regular structure, a forwarding device is provided having a pair of aprons, the downstream ends of which are separated from each other on downstream support rollers. However, in this case, it is difficult in actual practice to make the distance from the front nip point to the twisting point of the fluid eddy nozzle less than about 3 inches. Accordingly, in order to supply fibers having a length of about 1.5 – 3 inches to start spinning, it is necessary, in addition to stopping the negative pressure action of the branched pipe of the suction tube, to bring the transfer aprons into temporary contact with a point at the downstream ends of the transfer aprons or in the vicinity thereof, and to establish the distance from this temporary nip point to the twist point of the fluid eddy nozzle at a value less than the maximum fiber length of the staple fibers supplied.

It is a matter of course that it is desirable to be able to couple the operation of stopping the negative pressure action and the apron contacting operation into one manual or automatic action.

Stopping of the negative pressure action of the branched pipe of the suction tube may be carried out, for example, as follows. Namely, the branched pipe of the suction tube and the suction apparatus are connected by an elastic tube such as a rubber tube and the cross section thereof is closed by pinching the midway portion of said tube, or in the case of a rigid connecting tube, a shutter capable of opening and closing may be provided midway of such tube.

In the case of stopping the negative pressure action of the branched pipe by using an elastic tube as mentioned above, it is desirable to establish the distance from the inlet of the branched pipe to the holding point of the elastic tube at a value greater than the maximum fiber length of the supplied staple fibers, because there is reliability in the procedure of stringing up the yarn by sucking staple fibers in advance and then stopping the negative pressure.

Next, an explanation will be made with reference to a suitable method which is useful when yarn breakage occurs during spinning of a fasciated spun yarn in a spinning machine, which is a second object of the present invention. In a fasciated spun yarn spinning machine which is spinning at a high speed, when yarn breakage occurs, many "flies" are produced, large amounts of feed fibers are lost, and the fibers coil around the bundle feed means, tending to bring about difficulties. It is very important to handle such breakages without difficulty.

In order to achieve the aforementioned object, in the present invention, behind the bundle feed means, a pneumatic member is connected to the suction apparatus for the bundle. Subsequent thereto, a fluid eddy nozzle is provided for false twisting the bundle of staple fibers. Further, a yarn breakage detector is provided and the fasciated spun yarn spinning machine is provided with a stop device for the supply of feed fibers and a stop device for the supply of fluid to the fluid eddy nozzle, both of which are actuated by the signal of the yarn breakage detector. Thus, only those fibers remaining in the feed means at the time of yarn breakage are sucked and removed by the suction apparatus. This prevents said remaining fibers from blowing out as flies and as waste yarn. And because the feed fibers are not supplied continuously, the fibers do not coil around the rotating portion of the feed means for the bundle of staple fibers, and do not cause difficulties due to unstable suction action.

The yarn breakage detector may be of a known type. However, a detector so adapted as to actuate a limit switch by the motion of a feeler, and to generate an electrical signal, is easy to handle.

It is simplest to supply a fluid to the fluid eddy nozzle by an electromagnetic valve.

For stopping the supply of a material, when the material is composed of staple fibers, it is easy to hold a bundle of staple fibers by the action of solenoids provided at the rear of the back rollers of the staple fiber feed means and to pull out and cut off said bundle between the solenoids and the back rollers. Besides, the rotation of the back rollers of the feed means may be adapted to be stopped by a clutch. In this case, it is possible to supply the continuous material such as tow, using a draft-breaking (stapling) apparatus.

Next, an explanation will be made with reference to a method of temporarily stopping the fasciated spun yarn spinning machine during the spinning operation with the yarn remaining intact, and thereafter restarting the machine without causing yarn breakage. This is a third object of the present invention.

An object of this method resides in omitting troublesome repeated stringing up of a yarn on each spindle upon restarting the fasciated spun yarn spinning machine after the machine has been temporarily stopped because of normal doffing, or cessation of operation of the machine on a holiday, or due to minor repair work on the machine.

Such a fasciated spun yarn spinning machine comprises feed means for a bundle of staple fibers, preferably in the form of the front portion of a drafting apparatus, a suction tube arranged for a bundle of staple fibers to pass therethrough and connected to a suction apparatus, a fluid eddy nozzle, a take-up device, a winding device, a yarn breakage detector, a stop device for the supply of feed fibers and a stop device for the supply of fluid to the fluid eddy nozzle, which are actuated by the signal of the yarn breakage detector. Upon stopping the spinning machine at first, the stop device is adapted not to work even when a yarn slackens and the yarn breakage detector acts by mistake, so that supply of the material is not interrupted. As means therefor, for example, in the case of the stop device for stopping the supply of feed fibers, relays are adapted to operate in response to the electrical signal issued by the yarn breakage detectors, and solenoids are adapted to operate via said relays to hold the staple fibers between the solenoids and the back rollers, and suffice to turn off the switch of the operating power source for the yarn breakage detector.

Next, the feed means for the bundle of staple fibers, the take-up device and the winding device are simultaneously stopped. For this end, all of these three devices are adapted to be driven interlockingly by one main motor, by gear trains and a belt system and the switch for driving the main motor may be turned off. After all of these three devices completely stop, supply of fluid to the fluid eddy nozzle and application of negative pressure to the suction apparatus may be stopped. For this end, supply of a fluid to the fluid eddy nozzle is adapted to be carried out via an electromagnetic valve. At the same time, in an apparatus in which generation of a negative pressure for the suction device is carried out by rotation of a pneumatic fan, the electric circuit for its actuating may be turned off. This may be done automatically by turning off the main motor, using an appropriate timer. Because the revolving action of the fluid eddy nozzle continues until the driving system completely stops, yarn breakage does not occur while the machine is stopping.

Next, in order to restart the fasciated spun yarn spinning machine without causing yarn breakage, while the feed fibers stop device is kept inactive, at first, the supply of fluid to the fluid eddy nozzle and the action of the suction apparatus are started. Next, the feed means for the bundle of staple fibers, the take-up device and the winding device are simultaneously actuated. Lastly, the stop device for the supply of feed fibers is adapted to operate when yarn breakage occurs during spinning. In a fasciated spun yarn spinning machine having the aforementioned electric circuit and devices, it is possible to carry out all of these three operations electrically. Depending upon the aforementioned operations, the driving system is operated in such a way that one obtains the twisting action of the bundle of fibers under the influence of the fluid eddy nozzle and the suction action bundling the bundle of fibers. Therefore, yarn breakage does not occur. Moreover, even when a winding package slips relative to the drive rollers, and the yarn slackens at the time of starting, the stop device for the feed fibers is not actuated. Incidentally, upon starting the spinning machine, slow starting of the main motor is preferable, because yarn slackening may be prevented, and impact at the time of starting is not brought about.

In order to make more clear the description of the present invention, an explanation will now be made by reference to the drawings, of which:

Figure 1:
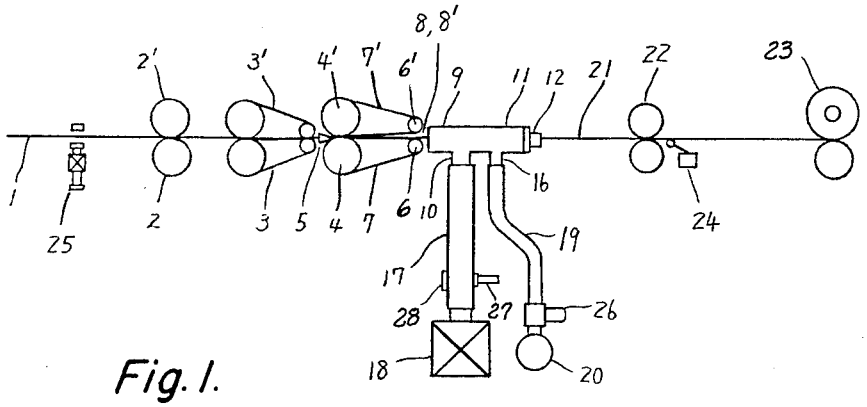
FIG. 1 is a schematic view of one process for producing a fasciated spun yarn embodying the present invention.

In FIG. 1, a material fiber such as roving or silver is drafted to a predetermined thickness by a conventional drafting apparatus consisting of back rollers, 2, 2', a pair of aprons 3, 3' and front rollers 4, 4'. A pair of transfer aprons 7, 7' is mounted on the front rollers 4, 4' in such a manner as to gradually separate from each other toward the downstream ends thereof. This separation of the transfer aprons 7, 7' in the downstream direction transmits false twist imparted to the draft bundle of staple fibers by fluid eddy nozzles 11, 12, as far as a nip point formed by the front rollers 4, 4'. Between the downstream ends of the aprons 3, 3' and the nip line of the front rollers 4, 4', a proper free gap is provided. Because of this gap, the bundle of staple fibers proceeding from the aprons 3, 3' to the front rollers 4, 4' encounters an air current brought about by the front rollers 4, 4'. A few outside fibers are gradually separated toward and to the outside of the fiber bundle. On the other hand, the greater part of fibers of the fiber bundle becomes a single bundle and is taken up by the front rollers. It is preferable to provide a collector guide 5 preventing the outside fibers from spreading more than necessary in the area between the aprons 3, 3' and the front roller 4, 4'.

When the draft fibers pass the nip line of the front rollers, the greater part of the fiber bundle is false twisted by the fluid eddy nozzle 11, 12, and the false twisted fibers proceed downstream while forming a bundle of false twisted fibers 8 between the transfer aprons 7 and 7' which separated downstream openings. On the other hand, a few outside fibers 8' are separated from the false twisted fiber bundle 8 at the edges and are not restricted. After coming out from between the nip rollers 4, 4', the fibers 8' proceed while being separated on both sides of the false twisted fiber bundle 8 on the transfer aprons, and are transferred.

Figure 2:
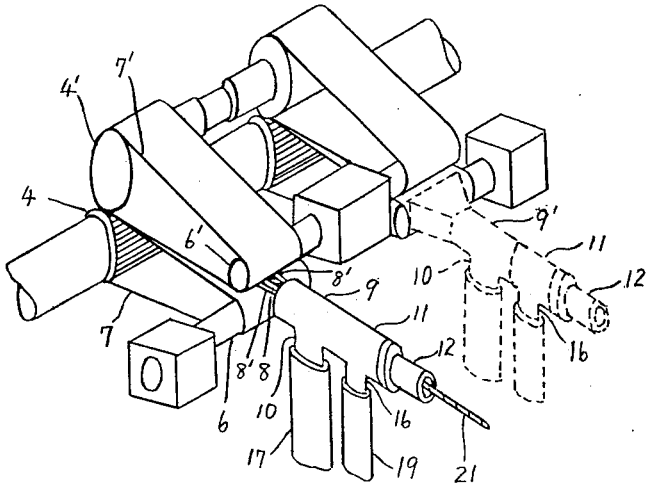
FIG. 2 is an enlarged perspective view showing a feed means for feeding a bundle of staple fibers, and a fluid eddy nozzle provided with a suction tube of the type shown in FIG. 1.

The transfer aprons 7, 7' are, as the enlarged view in FIG. 2 shows imparted with appropriate tension at the tips thereof, respectively by rotating axles 6, 6', which are supported by bearings. As the false twisted fiber bundle 8 and the outside fibers 8' proceed in the space between the transfer aprons 7 and 7', the outside fibers 8' are united with the false twisted fiber bundle 8 and are substantially parallel to the false twisted fiber bundle 8. For causing such uniting action, a suction tube 9, using a suction air current as shown in the enlarged view in FIG. 3, is used. The suction tube may be, besides a cylindrical shape as shown by solid line 9 in FIG. 2, a shape whose entrance spreads flatly as shown by dotted line 9' or other shapes. The suction tube besides being one that is integral with the body 11 of the fluid eddy nozzle, may be divided and then united with each other. The downstream portion of the suction tube 9 is connected to a small upstream side passage 13 of the nozzle 12. Accordingly, a strong suction air current is produced at the entrance (inlet) of the suction tube 9, imparting a strong suction action to the non-twisted outside staple fibers separated from the front rollers. A branch pipe 10 extending from the side surface of the suction tube 9 is connected via an elastic tube 17, such as rubber tube, to a suction duct 18 connected to a general suction apparatus of a pneumatic fan having a pneumatic box (not shown).

The bundle of staple fibers at the downstream portion of the suction tube 9 or at the inlet of the fluid eddy nozzle 12 has the outside fibers 8' in a weakly restricted condition adhering to the twisted bundle of staple fibers 8. The outside fibers 8' merely adhere and are far less twisted than the bundle of staple fibers 8 and are not in a strongly twisted state. As soon as the bundle of staple fibers passes a twisting point, namely, a fluid jet point, said bundle is untwisted. As a result, the false twisted fiber bundle 8 becomes substantially detwisted. On the other hand, the outside fibers 8' are actually twisted by the untwisting action of the other fibers, helically coiling around the core fiber bundle.

Figure 3A:
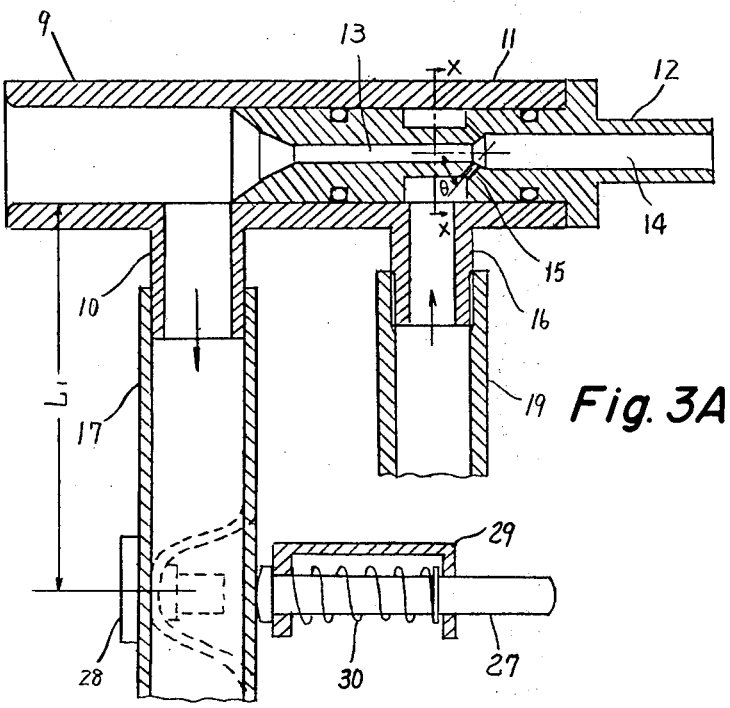
FIG. 3A is an enlarged transverse cross-sectional view showing one example of the fluid eddy nozzle having concurrently a suction action and a revolving action, which is integral with a suction tube, and one example of a device for temporarily stopping the suction action of the suction apparatus embodying the presention.
Figure 3B:
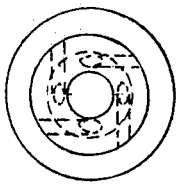
FIG. 3B is an enlarged cross section taken along line X — X of FIG. 3A showing a fluid jet opening (hole).

FIG. 3A shows one example of a fluid eddy nozzle, the inlet of which is directly connected to the suction tube 9. The fluid eddy nozzle 12 has a small entrance passage 13 and a large exit passage 14 and a plurality of holes 15 causing the fluid to go inside the exit passage 14 via pressure piping 20, an electromagnetic valve 26, a connecting passage 19 and a fluid inlet 16 tangentially at an angle at a connecting portion of the two passages for the purpose of causing an action to twist the bundle of staple fibers and causing a suction action at the entrance of the nozzle 12 as shown in FIG. 3B.

The smaller is the fluid jet angle $\theta$ of the hole 15, the larger becomes the suction effect. However, the weaker becomes the influence tending to twist the bundle of staple fibers. Normally, an appropriate value for the angle $\theta$ is 40° – 55°. As the fluid eddy nozzle, besides the form in FIG. 3, the shape of the passage may be straight or otherwise and the fluid jet hole may be provided in a plurality of nozzle cross sections.

Figure 4:
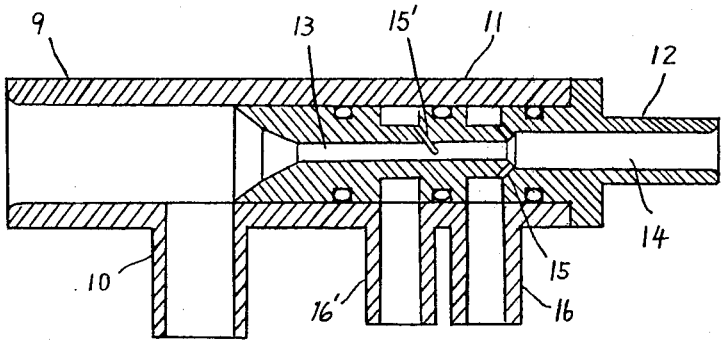
FIG. 4 is a transverse cross-sectional view of another example of the fluid eddy nozzle having concurrently a strong suction action temporarily at the time of starting spinning, but having hardly any sucking action during normal spinning operation.

FIG. 4 is an example of another fluid eddy nozzle adapted to provide temporarily a strong sucking action at the time of starting spinning, but have almost no sucking action during normal spinning operation. It thereby raises the twisting efficiency and reduces the consumption of fluid. On the entrance passage 13 of the fluid eddy nozzle shown in FIG. 3, second fluid jet holes 15' are provided tangentially at an angle so that there may be almost no sucking action. They cause a strong revolving action at the same time. For supplying a fluid to the hole 15 and 15', fluid inlets 16 and 16' are independently provided. At the time of starting spinning, a fluid is supplied to the hole 15 only, and thereafter the supply of fluid is shifted to the hole 15', and supply of fluid to the hole 15 is stopped.

Returning to FIG. 1, the bundle of staple fibers passing through the fluid eddy nozzle 12 becomes a fasciated spun yarn 21 which is wound upon winding device 23 via the take-up device 22.

In accordance with FIG. 1 and FIG. 3, an explanation will now be made with reference to a method of starting the spinning of a fasciated spun yarn.

In a first method, supply of a bundle of staple fibers is started from the aprons 7, 7' such that the suction of the suction apparatus operates on the suction tube. The bundle of staple fibers passes through the branch pipe 10 of the suction tube 9 and the elastic tube 17, and is removed to the suction duct 18. When a push rod 27 guided by a bracket 29 is pushed suddenly, the elastic tube 17 is pinched between the pinch rod 27 and a fixed plate 28, and a suction of the branch pipe 10 is stopped. By the suction of the fluid eddy nozzle 12, which is provided at least temporarily at this time, the bundle of staple fibers (continuously supplied) is sucked into the entrance passage 13 (FIG. 3), is further false twisted and comes out as a fasciated spun yarn together with the air current emanating from the exit of the exit passage 14. After that, the push rod 27 is freed and returns to its original position under the influence of a compression coil spring 30 (FIG. 3), causing a suction air current again inside the suction tube 9 as the bundle of staple fibers is in a normal spinning condition. In this method, it is necessary that the distance $L_1$ from the entrance (inlet) of the branch pipe 10 to the holding point of the elastic tube be more than the maximum fiber length of the staple fibers supplied, for the purpose of reliably stringing up the yarn without failure.

In a second method, one first pushes the push rod 27 to stop the suction air current of the branched pipe 10, a suction air current is initiated by the sucking action of the fluid eddy nozzle only inside the suction tube, and thereafter supply of the bundle of staple fibers from the aprons 7, 7' is started.

Figure 5A:
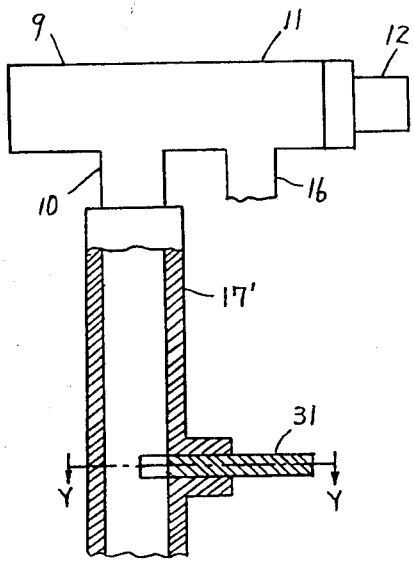
FIG. 5A is a transverse cross-sectional view showing another example of a device for temporarily stopping the suction action of the suction apparatus.
Figure 5B:
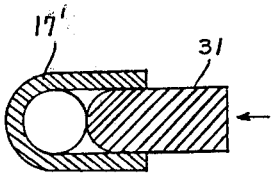
FIG. 5B is a cross-section taken along line Y—Y of FIG. 5A.
Figure 6:
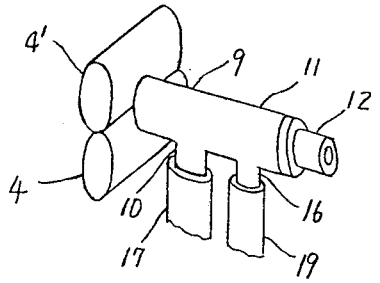
FIG. 6 is a perspective view showing another form of feed means for a bundle of staple fibers.

FIG. 5A is a longitudinal cross-sectional view showing another embodiment for temporarily stopping the suction air current of the branch pipe 10, and FIG. 5 (B) is a view in section taken along the line Y — Y of FIG. 5 (A). Transversely of a rigid tube 17' connecting the branch pipe 10 and the suction duct, a shutter 31 is provided. By reciprocating shutter 31 back and forth, the tube 17' may be opened and closed.

The feed means for the bundle of staple fibers may be, besides the transfer aprons 7, 7' shown in FIG. 2, a pair of front nip rollers 4, 4' only. However, when the feed means consists of the nip rollers only, coiling of the surface fibers lacks regularly and becomes random. In order to maintain the strength of the yarn, it is necessary to use staple fibers whose fiber length is longer.

In the aforementioned methods of starting spinning, it is necessary to use staple fibers whose fiber length is greater than the distance $L_2$ from the twisting point of the fluid eddy nozzle. Namely, this is the distance between the fluid jet point and the nip point of the feed means for the bundle of staple fibers. However, when the transfer aprons are used as in FIG. 1, it is difficult to set this distance at a value less than about 3 inches. Accordingly, for starting spinning of staple fibers having a short fiber length of up to about 1.5 inches, the transfer aprons 7, 7' may be temporarily brought into contact with each other at the downstream side in order to make the distance from the temporary nip point to the twisting point of the fluid eddy nozzle less than the maximum fiber length of the staple fibers.

Figure 7A:
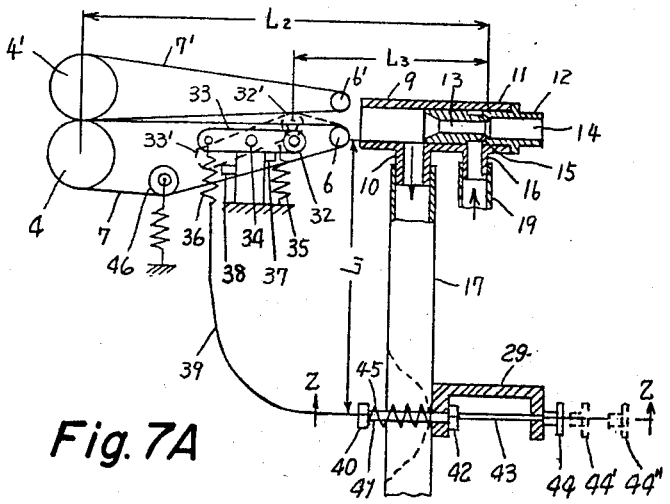
FIG. 7A is a schematic view showing another means for starting spinning in case the feed means for the bundle of staple fibers consists of double aprons the downstream ends of which are separated from each other.
Figure 7B:
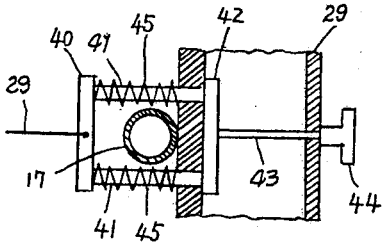
FIG. 7B is a view in section taken along line Z—Z of FIG. 7A.

FIG. 7A is a side elevation showing one embodiment of an apparatus suitable for this purpose. A rotating member 32 located inside the transfer apron 7 is fitted on an arm 33 swinging around a fulcrum 34. At ordinary times, the arm 33 comes into contact with a stopper 37 by a tensile coil spring 35 mounted on one end of the arm 33, and the rotating member 32 is so disposed as not to come into contact with the apron 7. On the other end of the arm 33, a tensile coil spring 36 is also mounted, and the other end of the spring connects with a flexible wire 39 one end of which is fixed to a member 40 holding the elastic tube 17. The temporary interruption of the suction air current of the branch pipe 10 is carried out by holding the elastic tube 17 between the bracket 29 and the holding member 40. At ordinary times, the holding (pinching) member 40 is kept at a position such that it is not holding down the elastic tube 17 by a compression spring 45 as shown in the cross-sectional view, FIG. 7B. The holding member 40 is connected to a knob 44 via a rod 41 guided by the bracket 29, a member 42 and a bar 43.

Upon starting up the spinning of the fasciated spun yarn, the apron 7 is lifted by the rotating member 32 to bring both aprons into contact with each other. At the same time, the elastic tube 17 is held to hereby cut the suction air current of the branched pipe 10. These operations may be carried out simultaneously; however, it is preferable to bring the aprons 7 and 7' into contact with each other first and then to cut the suction air in the elastic tube a little later. Namely, when an explanation is made by reference to FIG. 7A again, when the knob 44 is pulled out to the position 44', the arm 33 rotates until it stops against a stopper 38 (the position shown by dotted line 33'). At this time, the rotating member 32 transfers to the position 32' to lift the apron 7, which comes into contact with the apron 7' and temporarily nips the bundle of staple fibers. Thereafter, when the knob 44 is further pulled out to the position 44', the spring 36 continues to stretch during this period and the elastic tube 17 is eventually completely cut off.

When the knob 44 is freed, the respective members return to their original positions as influenced by the springs 35 and 45, and the aprons 7, 7' again separate from each other. Though being not indispensable, it is preferable to provide a tension roller 46 on the apron 7 to adapt to the change of length by the transfer of the rotating member 32.

Figure 8A:
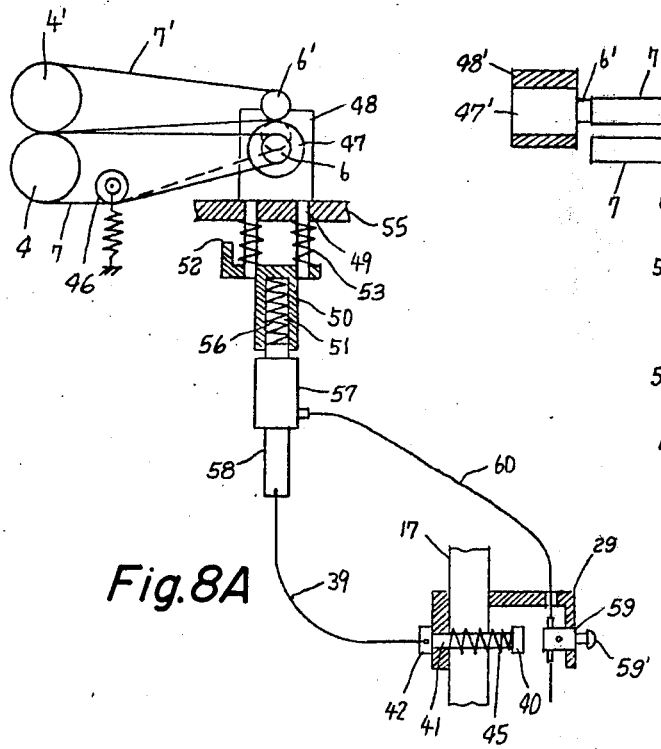
FIG. 8A is a schematic view showing still another means for starting spinning.
Figure 8B:
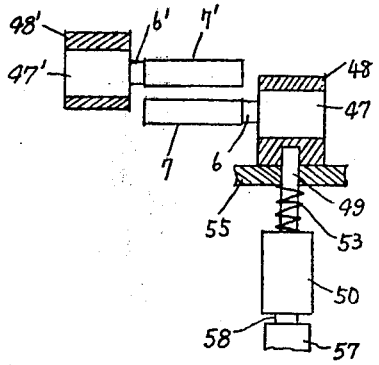
FIG. 8B is a front elevation showing a part of said means of FIG. 8A.

FIG. 8A is a side elevation showing another embodiment for bringing the downstream sides of the transfer aprons into contact with each other, and FIG. 8B is a front elevation showing a part thereof. In this embodiment, a supporting roller 6 at the downstream end of the transfer apron 7 is transferred to bring the same into contact with the apron 7'; at the same time, the transfer of the supporting roller 6 and the holding action of the elastic tube are carried out in a coupled motion by the transfer of the piston rod 58 of an air cylinder 57. Namely, the supporting roller 6 is pivotally supported by a bearing 47 fixed to a housing 48. On the housing 48, a rod 49 guided by a part of the frame 55 is fitted. Further, beyond said rod 49, a spring holder 50 is fixed. Between the spring holder 50 and a part of the frame 55, a compression coil spring 53 is provided, with keeps the supporting roller 6 at a position where the aprons 7, 7' are separated from each other at ordinary times.

Inside the bore 51 of the spring holder 50, a compression coil spring 56 is provided, which comes into contact with the tip of the piston rod 58. At the other tip of the piston rod 58, one end of a flexible wire 39 is fixed. The other end of this wire is connected to the devices 40, 41 and 42 holding the elastic tube 17. When a push rod 59' is pushed, compressed air is adapted to be supplied to the air cylinder 57 via a three-way valve 59 and piping 60. At this time, the supporting roller 6 is transferred until a part 52 of the spring holder 50 bears against a part 55 of the frame by the upward transfer of the piston rod 58 to bring the transfer aprons 7 and 7' into contact with each other. Thereafter, the spring 56 is further compressed continuously and finally the holding member 40 blocks off the elastic tube 17. After stringing up a yarn, when push botton 59' is freed, air flows out of the air cylinder 57 and the respective members return to their original positions by the actions of the springs 45, 53 and 56.

Next, an explanation will be made with reference to a method of treating yarn breakage when it occurs, for some reason or other, while spinning a fasciated spun yarn.

It is possible to produce a fasciated spun yarn normally at a speed of 100 – 200 m/min and further at a high speed of up to about 500 m/min. However, because spinning is carried out at such a high speed, when a pneumatic pipe is provided at the exit of the front rollers to suck and remove staple fibers further supplied at the time of yarn breakage as in the case of a ring pinning machine, the loss of material is large and the procedure is uneconomical. Also, the fibers coil around the front rollers, tending to become troublesome. Further, when the supply of fluid to the fluid eddy nozzle is continued at the time of yarn breakage, depending upon the location at which yarn breakage occurs, staple fibers are not twisted, but blow out per se "flies" from the fluid eddy nozzle. Alternatively, yarn continues to be formed as waste yarn, causing about various difficulties.

In order to solve these problems, it is desirable to provide a yarn breakage detector in a fasciated spun yarn spinning machine and, at the same time, to stop the supply of fluid to the fluid eddy nozzle in response to the signal of the yarn breakage detector. At the same time, it is desirable to stop the supply of feed fibers in response to said signal, and, further, to suck and remove the small amounts of fibers remaining in the feed means. This is done through the pneumatic pipe provided at the exit of the front rollers, preferably through the branch pipe of the suction tube for bundling and adhering the outside fibers to the core fibers which are false twisted in the suction apparatus.

Again, returning to FIG. 1, an electromagnetic valve 26 is provided on the midway portion of the tube connecting the pressure piping 20 and the fluid inlet 16 of the body 11 of the fluid eddy nozzle, said valve 26 is shut off to stop supply of fluid in response to the electrical signal issued at the time of yarn breakage from the yarn breakage detector 24. At the same time, the stop device for the feed fibers 25 using solenoids placed at the rear of the back rollers 2, 2' is actuated to hold the bundle of staple fibers, which is pulled out and cut off between the stop device 25 and the back rollers 2, 2' and the fibers remaining in the drafting portion may be sucked and removed to the suction duct 18 via the branched pipe 10 of the suction tube 9 and the elastic tube 17.

The suction tube used for the aforementioned disposal of the fibers resulting from yarn breakage may be integral with the fluid eddy nozzle as shown in FIG. 3, or may not be united, but may be shaped and separated therefrom, or further the suction opening of the suction tube may only face the exit of the feed means for the bundle of staple fibers, as in the case of an ordinary pneumatic pipe, in developing the same effect.

Figure 9A:
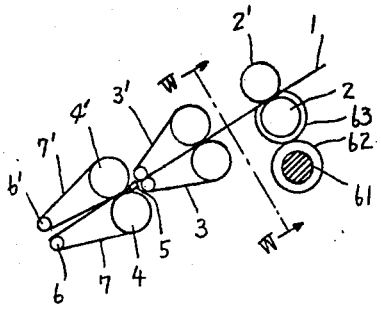
FIG. 9A is a view in side elevation showing another example of the stop device of supply of feed fibers.
Figure 9B:
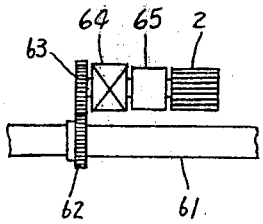
FIG. 9B is a front elevation of said device.

FIG. 9A is a view in side elevation showing another embodiment of the device for stopping the supply of feed fibers, and FIG. 9B is a view in section taken along the line W - W of FIG. 9A. The back bottom roller 2, journaled by a bearing 65, is geared so as to be driven and stopped per each spindle from a line shaft 61 via toothed wheels 62 and 63 driven by an electromagnetic clutch 64; at the time of yarn breakage, in response to the signal of the yarn breakage detector, the electromagnetic clutch 64 is turned off, and functions to stop the rotation of the back rollers 2, 2'.

Next, an explanation will be made with reference to a method of temporarily stopping the fasciated spun yarn spinning machine in operation without causing yarn breakage, and thereafter restarting the machine without requiring threading, and without causing yarn breakage, which is a third object of the present invention.

The fasciated spun yarn spinning machine comprises, as illustrated in FIG. 1, a feed means for a bundle of staple fibers preferably having a drafting function, a suction tube for bundling the outside fibers and producing a suction air current by the action of a suction apparatus, a fluid eddy nozzle, a take-up device, a winding device, a yarn breakage detector, a stop device for stopping the supply of feed fibers and a stop device for the supply of fluid to the fluid eddy nozzle, which are actuated by a signal of yarn breakage as issued from the yarn breakage detector.

Figures 10A, 10B:
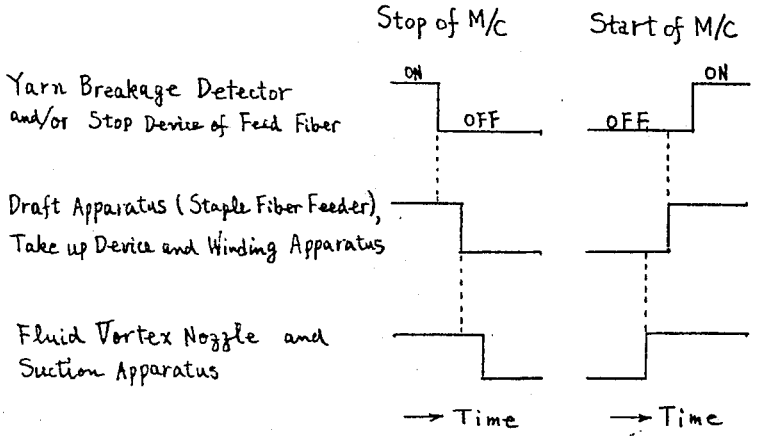
FIG. 10 is a sequence diagram showing sequences of actions of each device in case the fasciated spun yarn spinning machine of the present invention is temporarily stopped without causing yarn breakage and thereafter the machine is restarted.
Figure 11:
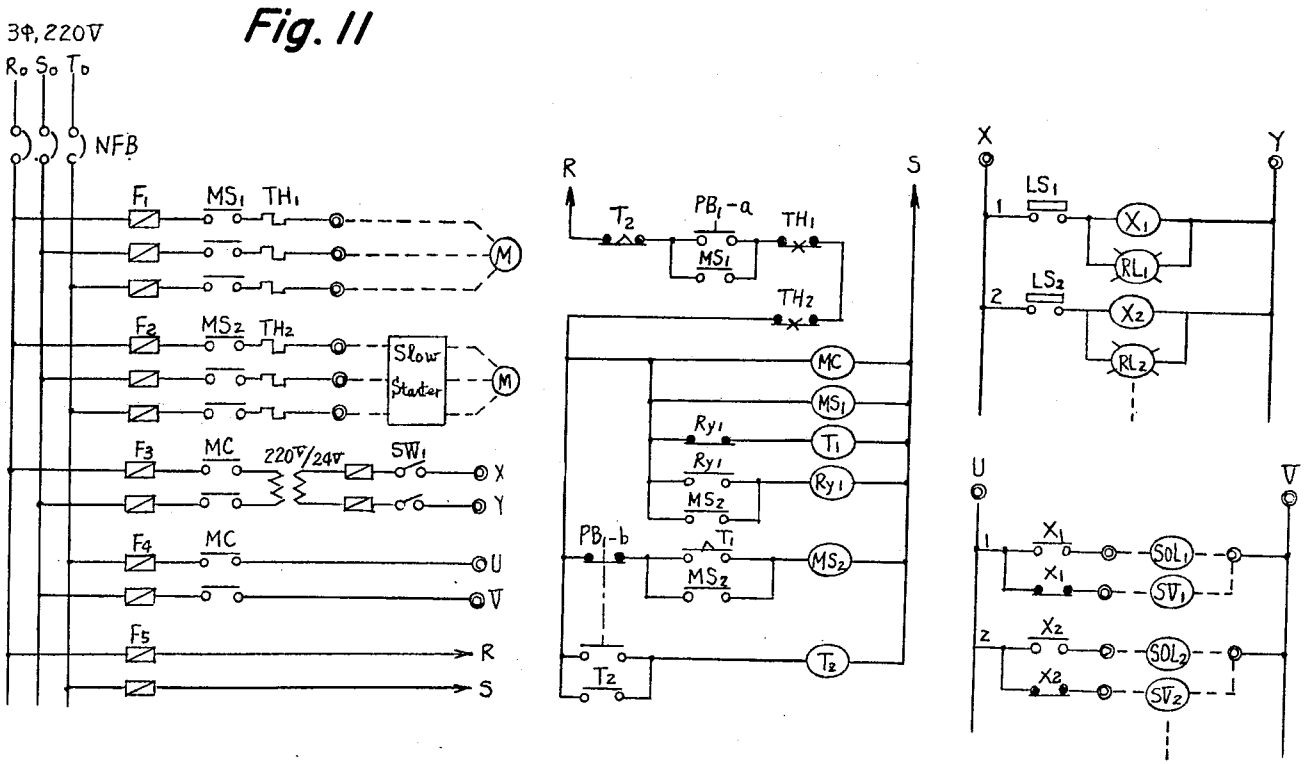
FIG. 11 is an example of an electrical circuit wiring diagram for peforming the sequences of FIG. 10.

The operation of the fasciated spun yarn spinning machine is stopped in accordance with the sequence shown in FIG. 10A. Further, upon restarting said machine, the operation is restarted in accordance with the sequence shown in FIG. 10B. FIG. 11 shows one example of an electric circuit wiring diagram provided in a fasciated spun yarn spinning machine for practicing such operations.

In accordance with FIG. 11, the operation of the spun yarn spinning machine will be explained.

Upon stopping the machine in operation, the power source switch ($SW_1$) of the yarn breakage detector is at first turned off so that the limit switches ($LS_1$, $LS_2$ . . . ) of the yarn breakage detector may not act erroneously by slackening of the yarn, and the solenoids ($SOL_1$, $SOL_2$ . . . ) of the stop device for the supply of feed fibers may not be actuated. Next, when a stop button ($PB_1$-*b*) is pushed, an electromagnetic switch $MS_2$ is opened and the electric current of the main motor $M_2$ interlockingly driving the draft apparatus, the take-up device and the winding device is cut off. Finally, a timer $T_2$ is actuated, which timer is set in expectation of the time when the main motor will stop completely, cutting off the electric current of the pneumatic fan motor $M_1$ of the suction apparatus. At the same time, an electromagnetic contact maker MC is cut; thereby the electric current of electromagnetic valves ($SV_1$, $SV_2$ . . . ) providing a supply of a fluid to the fluid eddy nozzle is cut off to stop the supply of the fluid. After that, a main switch (NFB) is turned off. Thus, it is possible to temporarily stop the fasciated spun yarn spinning machine while the yarn is intact.

Next, upon restarting the machine, at first the main switch NFB is turned on and the power source switch $SW_1$ for the yarn breakage detector is left as it is turned off. Next, when a starting button $PB_1$-a is pushed, the pneumatic fan motor $M_1$ starts to rotate. At the same time, the electromagnetic contact maker MC is turned on, an electric current runs in the electromagnetic valves ($SV_1$,$SV_2$ . . .) and supply of fluid starts. Thereafter, a little later under the influence of a timer $T_1$, the main motor $M_2$ starts to rotate. At this time, it is preferable to slow-start the main motor $M_2$ using a slow starter so that a package on the winding device will not slip and so that the yarn will not slacken excessively. Finally, the power switch $SW_1$ for the yarn breakage detector is turned on. Then, when yarn breakage occurs during spinning, the limit switch LS of the yarn breakage detector of the corresponding spindle contacts and a relay X actuates the selenoid SOL of the stop device for the supply of feed fibers actuates, at the same time, the electric current of the electromagnetic valve SV is shut out to stop supply of the fluid to the fluid eddy nozzle. Thus, the fasciated spun yarn spinning machine is restarted without causing yarn breakage.

As mentioned so far in detail, according to the present invention, the following major effects may be realized:

1 It is possible easily to string up a yarn without using an auxiliary yarn in the fasciated spun yarn spinning machine.

2 Accordingly, the operating time may be shortened, and at the same time, it becomes possible automatically to start spinning by use of a running-type automatic yarn piecing machine.

3 Even when yarn breakage occurs during spinning of the fasciated spun yarn, difficulties such as coiling of fibers around rollers of the draft apparatus, blowing out of fibers from the fluid eddy nozzle and production of waste yarn are not encountered and the material is not lost, with resulting economy.

4 Even when the operation of the fasciated spun yarn spinning machine is temporarily stopped while the yarn is intact, it is possible to restart the machine without causing yarn breakage, and it is possible to save time otherwise needed for stringing up a yarn at the time of restarting.

What we claim is:

1. A method for starting up the spinning of a fasciated spun yarn, which comprises sucking and false twisting into a yarn, a bundle of staple fibers supplied from a feed means having a nip point, applying to the bundle a fluid eddy (vortex) having a suction effect at the time the spinning is started, combining with said fluid eddy a suction separately applied, cutting off temporarily the suction air current separately provided and continuing the yarn formation while re-applying the suction air current separately applied.

2. A method according to claim 1, wherein said bundle of staple fibers is selectively nipped at an upstream location to provide downstream ends which are separated from each other at a distance to avoid obstructing transmission of false twist imparted to said bundle of fibers, back to a nip point upstream thereof.

3. A method according to claim 2, wherein another nip is temporarily formed on said bundle, downstream of the aforesaid upstream location, when starting spinning of the fasciated spun yarn.

4. A method of treating yarn breakage in spinning of a fasciated spun yarn on a spinning frame which comprises feeding a bundle of staple fibers, applying to said bundle suction and a fluid eddy in this order, detecting yarn breakage of the yarn thus produced, stopping the supply of feed fibers in response to said detection, stopping the supply of a fluid which provides said fluid eddy and sucking the remaining staple fibers of the fed pneumatically.

5. In a method of temporarily stopping the operation of a spinning frame which produces a fasciated spun yarn by feeding a bundle of staple fibers, sucking said bundle of staple fibers to pass in a downstream direction, applying a fluid eddy to said bundle, and taking up the resulting yarn, the steps which comprise inactivating the stopping of supply of feed fibers in response to the detection of yarn breakage, stopping said taking-up step, and stopping said fluid eddy and stopping said suction step.

6. In a method of restarting the operation of a spinning process for producing a fasciated spun yarn wherein a bundle of staple fibers is fed to the process, a suction is applied to a bundle of staple fibers, a fluid eddy is applied subsequently to said suction, and the resulting yarn is taken up, the steps which comprise supplying a fluid to the fluid eedy, and causing the suction to be applied, continuing the feed of said bundle of staple fibers, continuing taking up, detecting yarn breakage and stopping the supply of feed fibers in response to the yarn breakage detection.

7. A method according to claim 6, wherein said step of feeding said bundle of staple fibers, said take-up step and said winding step are simultaneously started at slow speed.

8. An apparatus for producing a fasciated spun yarn which comprises a feed means for feeding in a bundle of staple fibers, having a nip point arranged to nip said bundle of staple fibers, a fluid eddy nozzle having a suction effect at least temporarily on the occasion of starting spinning, the inlet of which is directly connected to a suction tube having a branch pipe connected to a suction apparatus, and means arranged and connected to cut off temporarily a suction air current flowing inside the branched pipe on the occasion of starting spinning.

9. An apparatus according to claim 8, wherein said feed means comprises a pair of top and bottom endless belts, the downstream ends of which are separated from each other at a distance to avoid obstructing transmission of false twist imparted to said bundle of fibers, back to the nip point adjacent the upstream ends of said endless belts.

10. An apparatus according to claim 9 further having a means for bringing said endless belts temporarily into contact with each other downstream of the aforesaid nip point on the occasion of starting spinning of a fasciated spun yarn.

11. An apparatus according to claim 10, wherein said means for bringing said endless belts into contact with each other is a transferable and rotatable element within at least one of said endless belts.

12. An apparatus according to claim 10, wherein said means for bringing said endless belts into contact with each other includes a downstream supporting roller for at least one of said endless belts.

13. An apparatus according to claim 10, wherein said contacting means and said device for cutting off suction air current are connected to each other by a coupling device.

14. An apparatus according to claim 13, wherein said coupling device comprises a flexible wire and a spring element.

15. An apparatus according to claim 8, wherein the related members are so disposed that the distance between the nip point for said bundle of staple fibers and the twisting point of said fluid eddy nozzle is less than the maximum fiber length of said staple fibers.

16. An apparatus according to claim 10, wherein the related members are so disposed that the distance between the temporary nip point of said endless belts and the twisting point of said fluid eddy nozzle is less than the maximum fiber length of said staple fibers.

17. An apparatus according to claim 8, wherein said branched pipe of said suction tube is connected to said suction apparatus, which comprises a pneumatic duct connected to a pneumatic fan by an elastic tube, and said means for cutting off suction air includes a pinching device for said elastic tube.

18. An apparatus according to claim 8, wherein said branch pipe of said suction tube is connected to said suction apparatus, which comprises a pneumatic duct connected to a pneumatic fan by a pipe, and said means for cutting off suction air current includes a shutter arranged to close the cross section of a connecting pipe connecting the branch pipe of the suction tube to the pneumatic duct.

19. An apparatus according to claim 8, wherein said means for cutting off suction air is so disposed that the distance between the inlet of said branch pipe and said cutting off means is more than the maximum fiber length of a bundle of staple fibers.

20. An apparatus for producing a fasciated spun yarn which comprises means for feeding a bundle of staple fibers, a pneumatic means, a fluid eddy nozzle, a yarn breakage detector, a stop device connected to stop the supply of a fluid to said fluid eddy nozzle, and a stop device connected to stop the supply of feed fibers, said stop devices being actuated by the signal of said yarn breakage detector.

21. An apparatus according to claim 20, wherein said stop device for said fluid includes a magnetic valve.

22. An apparatus according to claim 20, wherein said device for stopping supply of feed fibers is a holding device for holding a bundle of staple fibers upstream of said fiber feed means.

23. An apparatus according to claim 20, wherein said fiber feed means comprises roller drafting apparatus having front and back rollers, and said device for stopping supply of feed fibers is actuated to stop the back rollers of said roller drafting apparatus.

24. A spinning frame for producing a fasciated spun yarn which comprises means for feeding a bundle of staple fibers along a predetermined path, a take-up device, and a winding device both of which are simultaneously driven by a main motor, a suction tube for sucking said bundle of staple fibers having an opening through which said fibers pass in a downstream direction along said predetermined path, said tube having a branch pipe which is connected to a suction apparatus operated by a pneumatic fan, a fluid eddy nozzle downstream in said suction tube to which a compressed fluid is supplied through a valve controlling a fluid current, a yarn breakage detector and a stop device connected to stop the supply of feed fibers, said stop device being actuated by the signal of said yarn breakage detector.

25. A spinning frame according to claim 24 further having a control circuit which causes, on the occasion of stopping the operation of said spinning frame, said feed fibers stop device first of all to stop its function, said main motor thereafter to stop, and thereafter the supply of a fluid to said fluid eddy nozzle and said fan to stop.

26. A spinning frame according to claim 24 further having a control circuit which is connected to cause, on the occasion of restarting the operation of said spinning frame, supply of a fluid to said fluid eddy nozzle to start, and said pneumatic fan to operate, thereafter said main motor to rotate, and thereafter said feed fibers stop device to operate when yarn breakage occurs.

27. A spinning frame according to claim 26, wherein said main motor is driven by a slow speed starter.

* * * * *